United States Patent [19]

Mathews

[11] 4,203,479

[45] May 20, 1980

[54] TRASH BAG PROTECTOR

[76] Inventor: Arlene L. Mathews, 7634 Long, Shawnee Mission, Kans. 66216

[21] Appl. No.: 903,826

[22] Filed: May 8, 1978

[51] Int. Cl.[2] ..... B65D 33/24

[52] U.S. Cl. ..... 150/3; 150/25

[58] Field of Search ..... 150/3, 20, 21, 22, 23, 150/24, 25, 26, 27, 1

[56] References Cited

U.S. PATENT DOCUMENTS

| | | | |
|---|---|---|---|
| 218,045 | 7/1879 | Mertz | 150/20 |
| 530,683 | 12/1894 | George | 150/23 |
| 931,853 | 8/1909 | Forehaud | 150/23 |
| 984,540 | 2/1911 | Clark | 150/20 |
| 1,814,378 | 7/1931 | Gilbertson | 150/1 |
| 2,178,611 | 11/1939 | Scheidegger | 150/3 |
| 3,348,595 | 10/1967 | Stevens | 150/3 |
| 3,756,300 | 9/1973 | Nalle | 150/3 |

FOREIGN PATENT DOCUMENTS 350767 1/1961 Switzerland .

*Primary Examiner*—Stephen P. Garbe

*Attorney, Agent, or Firm*—D. A. N. Chase; Michael Yakimo, Jr.

[57] ABSTRACT

A device for protecting filled trash bags from attacks by dogs or other animals is disclosed, and has a collapsible mesh frame composed of interwoven plastic strands and which presents an open top defined by an upper rim. The open top is closed by eight equally spaced straps whose outer ends are attached to the rim. The inner end of one of the closure straps is provided with an upstanding post upon which the inner ends of the other straps can be installed. Thus installed, the straps extend radially outwardly from the post to the rim and may be locked in place, thereby securing the bags in the protector device.

8 Claims, 5 Drawing Figures

Fig. 1.
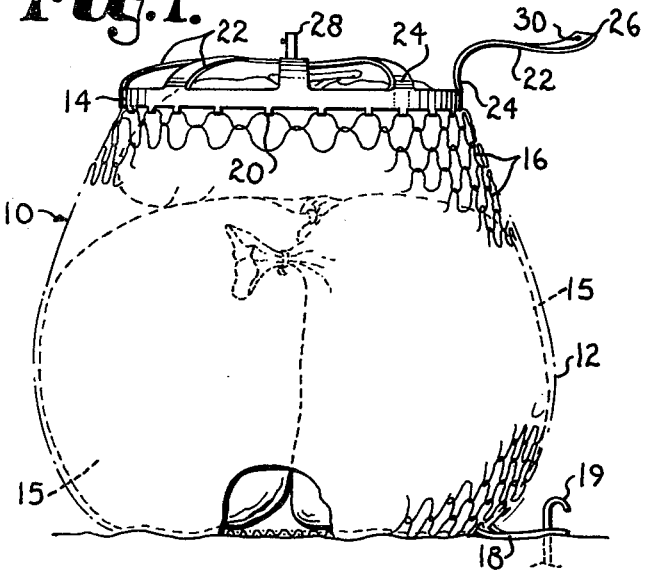
Fig. 4.
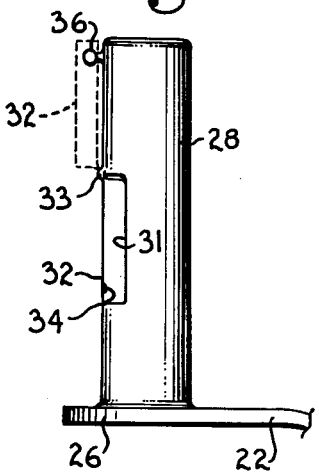
Fig. 3.
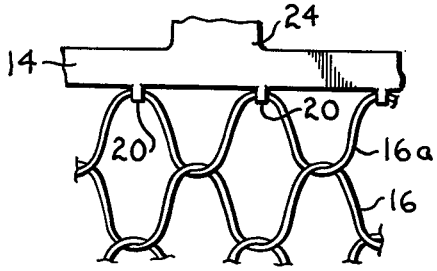
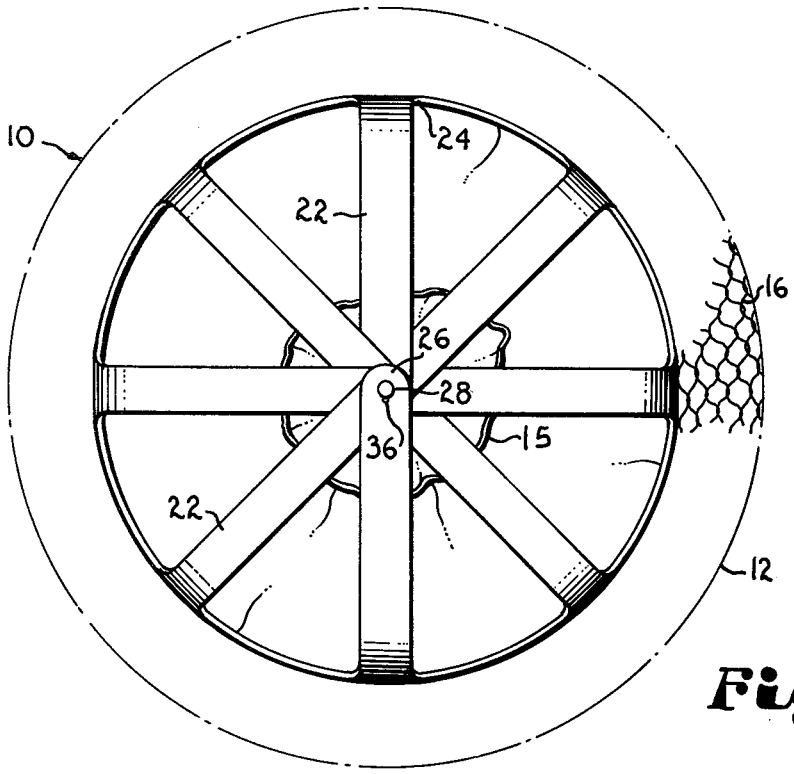
Fig. 2.
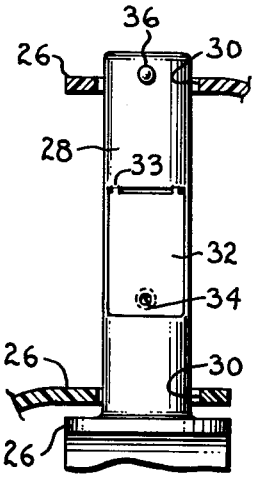
Fig. 5.

TRASH BAG PROTECTOR

This invention relates to improvements in devices for protecting trash bags, and in particular to an improved trash bag protector which is detachable from the ground and collapsible for easy storage.

Since most municipalities have banned residential trash burning, it has become common to collect unwanted trash in large plastic bags and leave such bags at the curbside for pick-up by public or private collection. Since the exact time of the pick-up of the bags cannot be precisely determined, and since often no one is home, trash bags are oftentimes left at curbsides for several hours or even overnight. A serious problem has arisen where dogs or other animals have ripped open trash bags, which emitted attracting odors, and have spread the trash contained in the bags all over the adjacent yards. It is often an extremely unpleasant and difficult task to pick up the contents of the ripped trash bags, particularly if they should happen to have contained garbage.

One proposed solution to this problem is to coat the plastic trash bags with a chemical which emits odors that are repugnant to dogs or other animals. However, chemically coated bags are relatively ineffective and are as repugnant to man as they are to animals.

Another solution to the above-described problem is to construct a large wooden basket mounted at the curbside of a home and spaced above the ground by a large post. The trash bags can then be placed in the wooden basket and removed by refuse collectors. The advantage here is, since the bags are in the basket above the ground, dogs and other animals are unable to reach them. However, these large trash bag holders are unsightly, expensive to construct and are a permanent attachment to the curbside of the lawn. Furthermore, some communities, notably Kansas City, Missouri, have banned their use.

With the foregoing in view, it is the primary object of the present invention to provide an improved trash bag protector that adequately protects trash bags from dogs and other animals, but overcomes the problems encountered by the prior art as discussed above.

Specifically, it is an important object of this invention to provide a trash bag protector which is detachable from the ground, when not in use, and is collapsible for easy storage.

Another important object of this invention is to provide a trash bag protector as aforesaid having a collapsible mesh frame including interwoven strands forming a network of plastic webbing.

Still another important object of this invention is to provide a trash bag protector as aforesaid that may be tethered to the ground.

Yet another important object of this invention is to provide a trash bag protector as aforesaid which presents an open top for easy trash bag insertion and withdrawal, and has a closure structure attached thereto for securing the bags in the protector after insertion therein.

Furthermore, another important object of this invention is to provide a trash bag protector as aforesaid wherein the above-mentioned closure structure is selectively operable and can be easily released, whereby the bags can be easily withdrawn from the protector by a collector.

Additionally, an important object of this invention is to provide a trash bag protector as aforesaid that is inexpensive to manufacture, portable and lightweight, but is still durable and capable of withstanding attacks by dogs and other animals.

In the drawings:

FIG. 1 is an elevational view of the trash bag protector of the present invention;

FIG. 2 is a top plan view of the trash bag protector shown in FIG. 1, on a larger scale and with the top fully closed;

FIG. 3 is an enlarged, fragmentary view showing a portion of the upper rim of the trash bag protector connected to the top strand of the mesh;

FIG. 4 is a detail view of the post of the protector lock shown in its strap-receiving condition and in broken lines in its obstructing condition; and FIG. 5 is a detail view similar to FIG. 4 with the post in its strap-receiving condition and illustrating the installation of straps thereon.

DETAILED DESCRIPTION

The trash bag protector 10 as shown in FIGS. 1–3 has a body section 12 presenting an open top defined by a continuous upper rim 14. The body section 12 receives trash bags 15 and is of a generally spherical configuration, and tends to assume a shape conforming to the number of bags and the manner in which they are placed in the trash protector 10. The body section 12 has a collapsible mesh frame comprised of a network or web of interwoven plastic strands 16. The plastic strands 16 are interwoven by virtue of their interconnections in a zigzag pattern as shown with particularity in FIG. 3. When no trash bags 15 are in the trash protector 10 to hold the plastic strands 16 apart from each other as shown in FIGS. 1–3, the body section 12 will collapse since there is no support in the body section 12 to maintain it in the expanded condition illustrated. Accordingly, the flexible plastic strands 16 will collapse one on top of another. The body section 12 in its collapsed position takes up little space and can be easily stored when not in use.

A rope 18 has one of its ends connected to a suitable portion of the mesh of the body section 12 near the bottom thereof. The other end of the rope 18 is tied around a stake or peg 19 driven in the ground. A chain may be used in lieu of the rope if preferred. The rope 18 thus serves as a tether so that the trash bag protector can only be moved a limited amount by dogs or other animals. Furthermore, the plastic mesh of the body section 12 provides a barrier to prevent an animal's paw from being able to rip into the trash bags 15.

The upper rim 14 is connected to the uppermost strand **16*a* by means of closed connecting fingers 20 at regularly spaced intervals, formed by depending eyelets through which strand 16*a* is threaded. Eight straps 22 are attached at their outer ends 24 to the upper rim 14 and are equally angularly spaced at such outer ends 24 as is clear in FIG. 2. The rim 14 and straps 22 may be integrally formed of a flexible plastic material if desired. The straps 22 would normally lie over the open top of the trash protector 10 and would be supported by the trash bags therein as shown in FIGS. 1 and 3 where three bags 15 are illustrated. In FIG. 1 the far right strap is in its folded-back position wherein the straps would be clear of the rim 14** to permit the trash bags to be inserted through the open top thus presented.

Each of the straps 22 also has an inner end 26. An upstanding post 28 is attached to one of the inner ends 26. Each of the other inner ends 26 has an opening 30 which allows it to be installed on the post 28. In FIG. 5 one of the straps 22 (inner end 26) has been completely installed on the post 28 while another strap shown on the upper portion of the post 28 is in the initial stages of installation.

The post 28 has a middle recessed portion 31 receiving a lock piece 32 which is configured so that when the lock piece 32 is in the recess 31, the post 28 presents a smooth cylindrical surface on which the inner ends 26 of the other straps 22 may be installed. When all the inner ends of the other straps 22 are installed on the post 28, the lock piece 32, which is mounted on the post by a hinge 33, may be swung from its strap-receiving position (as shown in full lines in FIG. 4) to its locked or obstructing position shown in broken lines in FIG. 4. The lock piece 32 is held in such obstructing position by a snap fastener formed by a protuberance 36 adjacent the top of the post 28 which is received within a mating opening 34 in the lock piece 32. The curved lock piece 32 is shaped so that when held by the protuberance 36 the other inner ends 26 of the straps 22 cannot pass up and over the post 28. Therefore, dogs and other animals are not able to separate the secured inner ends of the straps 22 when the lock piece 32 is in its obstructing or blocking position. However, refuse collectors will be able to easily release the snap fastener and disengage the straps 22 to remove the trash bags 15.

Having thus described the invention, what is claimed as new and desired to be secured by Letters Patent is:

1. A trash bag protector comprising:

a body section having a collapsible mesh frame and presenting an open top for trash bag insertion and withdrawal therethrough, a continuous rim, means connecting said open top to said rim at spaced points of attachment therearound, a closure for said open top provided with a plurality of straps having inner and outer ends, and means attaching said outer ends to said rim at spaced zones of attachment thereon, and said inner ends having cooperating parts for releasably securing said inner ends of said straps to one another, centrally of said rim to cause the straps to converge upon one another at their inner ends and span said top, whereby said straps preclude said trash bag insertion and withdrawal through said open top when said inner ends are secured.

2. A trash bag protector as claimed in claim 1 wherein said cooperating parts comprise:

an upstanding post on one of said inner ends, and each of the other of said inner ends having an opening therein rendering said other inner ends capable of being installed on said post with the latter extending through said openings.

3. The trash bag protector as claimed in claim 2, further comprising selectively operable locking means on said post for preventing said other inner ends from being inadvertently removed from said post.

4. The trash bag protector as claimed in claim 3, wherein said locking means includes a recess in said post, a locking member hingeably mounted on said post and capable of being received in said recess to permit said other inner ends to be installed over said post, and releasable fastening means on said post engageable with said locking member for securing the latter in a blocking position out of said recess, whereby to prevent removal of said other inner ends from said post when said fastening means is engaged.

5. The trash bag protector as claimed in claim 1, wherein said collapsible mesh frame includes a network of interwoven strands.

6. The trash bag protector as claimed in claim 5, wherein said strands comprise a plastic material.

7. The trash bag protector as claimed in claim 5, wherein said strands present a zigzag mesh pattern, an uppermost strand of said pattern being connected to said rim at spaced points of attachment therearound.

8. The trash bag protector as claimed in claim 1, further comprising a tether connected to said body section and adapted to operate between said body and the ground.

* * * * *